US005662039A

United States Patent [19]

Watanabe et al.

[11] Patent Number: 5,662,039

[45] Date of Patent: Sep. 2, 1997

[54] RECORDING APPARATUS FOR SELECTIVELY SUPPLYING A SOLVENT TO PERFORATE A STENCIL SHEET

[75] Inventors: Hideo Watanabe; Hiroyuki Ikeda, both of Tokyo, Japan

[73] Assignee: Riso Kagaku Corporation, Tokyo, Japan

[21] Appl. No.: 525,141

[22] Filed: Sep. 8, 1995

[30] Foreign Application Priority Data

Sep. 16, 1994 [JP] Japan ..... 6-221783

[51] Int. Cl.[6] ..... B41F 15/10; B41L 13/06

[52] U.S. Cl. ..... 101/116; 101/115; 101/128.4; 101/129; 347/2

[58] Field of Search ..... 101/115, 116, 101/128.21, 128.4, 129; 347/2, 95

[56] References Cited

U.S. PATENT DOCUMENTS

| | | | |
|---|---|---|---|
| 4,423,676 | 1/1984 | Neel | 101/116 |
| 4,597,829 | 7/1986 | Sato et al. | 101/128.4 |
| 5,154,121 | 10/1992 | Schneider | 101/401.1 |
| 5,373,350 | 12/1994 | Taylor et al. | 347/3 |
| 5,511,477 | 4/1996 | Adler et al. | 101/128.4 |

FOREIGN PATENT DOCUMENTS

| | | | |
|---|---|---|---|
| 55-83079 | 6/1980 | Japan | 347/2 |
| 61-12387 | 1/1986 | Japan | 101/128.4 |
| 61-12395 | 1/1986 | Japan | 101/128.21 |
| 1 431 462 | 4/1976 | United Kingdom . | |
| 2 220 815 | 1/1990 | United Kingdom . | |

*Primary Examiner*—Stephen R. Funk
*Attorney, Agent, or Firm*—Kanesaka & Takeuchi

[57] ABSTRACT

A recording apparatus is formed of a drum which is rotationally driven around a central axis of itself with a stencil sheet having a solvent-soluble resin layer wrapped around an outer circumferential surface of the drum, an ink supplying device disposed to the inside of the drum and supplying ink to an inner circumferential surface of the drum, and a solvent supplying device for selectively supplying a solvent containing a colorant to the stencil sheet, thereby conducting perforating the stencil sheet and selectively supplying the solvent to the printing paper thereby conducting recording.

7 Claims, 2 Drawing Sheets

RECORDING APPARATUS FOR SELECTIVELY SUPPLYING A SOLVENT TO PERFORATE A STENCIL SHEET

BACKGROUND OF THE INVENTION

The present invention concerns a recording apparatus having both a stencil printing function suitable for a great number of sheets and a recording function suitable for a small number of sheet printing.

An existent stencil printing apparatus uses a heat sensitive stencil sheet comprising a thermoplastic resin film layer laminated on a porous substrate. For perforating a heat sensitive stencil sheet, a heating means such as a thermal head having a plurality of dot-like heat generating bodies has been used for example. The heat generating bodies of the thermal head and the stencil sheet are moved while being in contact relative to each other and character image information is given in the form of electric signals to the thermal head in synchronization with the movement. The heat generating body of the thermal head generates heat selectively to melt and puncture the stencil sheet and forms punctured images corresponding to the character image information onto the stencil sheet.

The perforated stencil sheet is wound around a drum of a stencil printing apparatus. An ink supplying device is disposed to the inside of the drum. The drum is rotated and, at the same time, ink is supplied to the inner circumferential surface of the drum and, further, printing paper is fed between a roller disposed away from the drum and the drum. Ink passes through an ink passing portion of the drum and the punctured portion of the stencil sheet to the printing paper, by which images corresponding to the punctured images of the stencil sheet are printed on the printing paper. The preparing/printing method or apparatus as explained above has already been proposed as a digital printing machine and has been popularized as a recording apparatus at a low running cost.

The digital printing machine is used in a case of printing a number of identical printed matter simultaneously but, if the number of printing sheets is small, the printing cost is rather increased since the cost of the stencil sheet per sheet of the printed matter requires a high cost. For obtaining a small number of printed matter, there is a method of directly recording by a thermal head of a digital printing machine to heat sensitive recording paper or heat sensitive transfer recording paper, but incorporation of the heat sensitive recording paper or heat sensitive transfer recording paper in the printing machine has a drawback of enlarging the printing machine and complicating the operation of providing both printing paper for stencil printing and recording paper with small number of printing.

Further, a composite type printing apparatus has also been proposed which combines different printing methods of using only one kind of common paper for the printing paper, conducting electrophotographic printing in a case where the number of printing sheets is small and conducting printing by using heat sensitive stencil sheet in a case of a large number of printing sheets, but it has a drawback that the entire system is complicated, expensive and enlarged in the size.

On the other hand, in a case of obtaining colored printed matter by the digital printing machine, an ink-charged drum has to be provided for each of colors, and it requires a troublesome operation of exchanging the drum upon printing each color with the drum of the corresponding color also in a partial color printing, to worsen the efficiency.

An object of the present invention is to provide a small-sized recording apparatus capable of overcoming the foregoing problems in the prior art and obtaining printed matter of multiple colors from a small number of sheets to a large number of sheets at a low running cost.

SUMMARY OF THE INVENTION

The recording apparatus as defined in the first aspect of the present invention, comprises a drum which is rotationally driven around a central axial line of itself with a stencil sheet having a solvent-soluble resin layer wrapped around an outer circumferential surface of itself, an ink supplying means disposed to the inside of the drum and supplying an ink to an inner circumferential surface of the drum, and a solvent supplying means for selectively supplying a solvent containing a colorant to the stencil sheet for perforating the stencil sheet and selectively supplying the solvent to a printing paper to conduct recording.

A recording apparatus defined in the second aspect of the present invention comprises a plurality of solvent supplying means for supplying a plurality kinds of solvents containing different kinds of colorants in the first aspect.

In the recording apparatus defined in the third aspect of the present invention, the solvent supplying means perforates the stencil sheet before attachment to the outer circumferential surface of the drum in the recording apparatus as defined in the first aspect.

In the recording apparatus defined in the fourth aspect of the present invention, the solvent supplying means perforates the stencil sheet attached to the outer circumferential surface of the drum in the recording apparatus as defined in the first aspect.

In the recording apparatus defined in the fifth aspect of the present invention, the solvent supplying means is made movable between a position for supplying the solvent to the stencil sheet and a position for supplying the solvent to the printing paper in the recording apparatus as defined in the first aspect.

The recording apparatus as defined in the sixth aspect of the present invention comprises a first solvent supplying means for supplying a solvent to the stencil sheet for conducting perforation, and a second solvent supplying means for supplying the solvent to the printing paper for conducting recording.

In a case of printing a large number of sheets, a stencil sheet having a solvent-soluble resin layer is used. The solvent supplying means discharges the solvent selectively in a contactless manner to the solvent-soluble resin layer of the stencil sheet attached to the drum or to the solvent-soluble resin layer of the stencil sheet before it is attached to the drum. The solvent supplied in a contactless manner from the solvent supplying means dissolves the solvent-soluble resin layer. A punctured portion is formed to the solvent-soluble solution layer to complete preparation. Printing paper is supplied to the drum to which the stencil sheet after make-up is attached. Ink supplied by the ink supplying means in the drum is transferred by way of the drum and the punctured portion of the stencil sheet to the print paper to apply stencil printing to the printing paper.

There is less occurrence of creasing and transportation failure upon make-up. Upon attaching the stencil sheet to the drum, if the stencil sheet runs orthogonally and attached orthogonally or even if creasing should occur, since preparation can be conducted in the contactless manner, the stencil sheet is not wasted. Since no melted materials remain in the punctured portion, clear printed matter can be obtained.

In a case of printing a small number of sheets, the solvent supplying means supplies the solvent to the printing paper. Since a colorant is contained in the solvent, characters, images, etc. can be recorded simply on the printing paper.

Both of recording by the solvent supply means suitable to recording for a small number of sheets and printing by using a stencil sheet suitable to printing for a large number of sheets can be conducted individually or in combination by merely providing one kind of printing paper and a stencil sheet and controlling the solvent supplying means in the recording apparatus.

Color recording can be conducted by supplying different kinds of solvents containing different colorants from a plurality of solvent supplying means to the printing paper.

DETAILED DESCRIPTION OF PREFERRED EMBODIMENTS

The recording apparatus of this embodiment has a function of conducting stencil printing to printing paper by using a stencil sheet and a function of conducting printing by discharging a colorant-incorporated solvent by a solvent supplying means directly to the printing paper. Then, the stencil sheet used in the recording apparatus of this embodiment comprises a solvent-soluble resin layer laminated on a porous substrate and preparation for the paper can be conducted by selectively discharging the solvent from the solvent supplying means to the solvent-soluble resin layer of the stencil sheet, thereby dissolving and puncturing the solvent-soluble resin layer.

In the recording apparatus of this embodiment, the stencil printing is conducted in a case of requiring a large number of identical printed matter, and recording by the solvent is used in a case where the number of required identical printed matter is small. Further, both of the printing methods may be used in combination. That is, both of stencil printing and direct recording by the solvent can be applied to one sheet of printing paper. At first, description will be made to a stencil sheet having a solvent-soluble resin layer and a solvent dissolving the solvent-soluble resin layer and then the preparation mechanism using them is explained.

Figure 2:
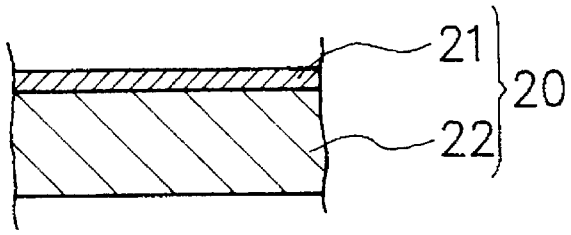
FIG. 2 is a cross sectional view of a stencil sheet used in one embodiment of the present invention.

FIG. 2 is a cross sectional view of stencil sheet 20 used in one embodiment of the present invention. The stencil sheet 20 is formed with a solvent-soluble resin 21 on one surface of a porous substrate 22.

The stencil sheet 20 of the above-mentioned structure can be manufactured, for example, by the following exemplified methods (1)–(4), (1) A method of appending a solvent-soluble resin film as a solvent-soluble resin layer and a porous substrate by means of a bond, adhesive or the like.

(2) A method of thermo-fusing a solvent-soluble resin film as a solvent-soluble resin layer to a porous substrate.

(3) A method of coating and drying a resin solution dissolved or dispersed in a solvent on a porous substrate to form a solvent-soluble resin layer.

(4) A method of coating and drying a resin solution dissolved or dispersed in a solvent on a peelable support to form a solvent-soluble resin layer and, appending the peelable support having the solvent-soluble resin layer with a porous substrate and, subsequently, peeling the peelable support.

As the porous substrate 22 used in this embodiment, there can be mentioned natural fibers such as Manila hemp, pulp, mitsumata, paper mulberry, Japanese paper, synthetic fibers such as polyester, nylon, vinylon and acetate, nonwoven fabric, metal fibers, tissue paper using glass fibers, etc. alone or in admixture, non-woven fabric and screen silk gauze.

The unit weight of the porous substrate is preferably within a range from 1 to 20 g/m$^2$, more preferably within range from 5 to 15 g/m$^2$. If it is less than 1 g/m$^2$, strength as the stencil sheet is deteriorated. If it exceeds 20 g/m$^2$, ink passage upon printing may be deteriorated. Further, the thickness of the porous substrate is preferably within a range from 5 to 100 μm and, more preferably, within a range 10 to 50 μm. If it is less than 5 μm, the strength as the stencil sheet is also deteriorated. If it exceeds 100 μm, the ink passage upon printing may be worsened.

The solvent-soluble resin layer 21 used in this embodiment contains a thermoplastic resin or a thermosetting resin soluble to water or a solvent such as an organic solvent as a main ingredient. As the resin ingredient soluble for water or the organic solvent, there can be used, for example, polyethylene, polypropylene, isobutylene, polystyrene, polyvinyl chloride, polyvinylidene chloride, polyvinyl fluoride, polyvinyl acetate, acrylic resin, polyacrylonitrile, polyamide, polyimide, petroleum resin, phenol resin, amino resin, epoxy resin, polyester, polycarbonate, polyurethane, polysulfone, silicone resin, alkyd resin and melamine resin. The resin ingredient may be used alone or in admixture or as a copolymer.

As the water soluble resin ingredient, there can be used a resin soluble to water or water immiscible organic solvent, for example, polyvinyl alcohol, methyl cellulose, carboxymethyl cellulose, hydroxyethyl cellulose, polyvinyl pyrrolidone, polyethylene-polyvinyl alcohol copolymer, polyethylene oxide, polyvinyl ether, polyvinyl acetal, polyacrylamide, starch, dextrine, alginic acid, ascorbic acid or water soluble urethane. The resin may be used alone or in admixture, or may be used as a copolymer.

The solvent-soluble resin layer 21 may contain, in addition to the resin ingredient, dye, pigment, filler, binder, curing agent and the like.

The thickness of the solvent-soluble resin layer is desirably within a range from 0.1 to 100 μm, preferably, within a range from 0.5 to 50 μm. If the thickness is less than 0.1 μm, the strength of the resin layer is insufficient. If it exceeds 100 μm, it requires a great amount of solvent or water for dissolving the resin layer to possibly result insufficient dissolution.

Explanation will next be made to the solvent for dissolving the solvent-soluble resin layer 21 of the stencil sheet 20. As the solvent for dissolving the solvent-soluble resin layer 21, there can be mentioned, for example, aliphatic hydrocarbon type, aromatic hydrocarbon type, alcohol, ketone type, ester type, ether type, aldehyde type, carbonic acid type, amine type, low molecular heterocyclic compound, oxide type and water. For example, there can be mentioned, hexane, heptane, octane, benzene, toluene, xylene, methanol, ethanol, isopropanol, n-propanol, butanol, ethylene glycol, diethylene glycol, propylene glycol, glycerine, acetone, methyl ethyl ketone, ethyl acetate, propyl acetate, ethyl ether, tetrahydrofuran, 1,4-dioxane, formic acid, acetic acid, propionic acid, formaldehyde, acetoaldehyde, methyldiamine, dimethyl formamide, pyridine and ethylene oxide. They may be used alone or in combination.

The solvent is used for conducting preparation by dissolving and puncturing the solvent-soluble resin layer of the stencil sheet, and also to printing by itself other than preparation. Accordingly, it contains a colorant such as a dye or pigment for forming images on the printing paper. Further, the solvent may optionally be incorporated with filler, binder, curing agent, corrosion inhibitor, wetting agent, surfactant and Ph controller.

The solvent is discharged in the form of droplets by a solvent supplying means. As the solvent supplying means there can be used a nozzle having 10 to 2,000 (10 to 2,000 dpi) apertures per one inch, slit, injector, porous member, porous film connected to piezoelectric device, heat generating device, electric field device or liquid feeding pump. The solvent can be discharged intermittently or continuously in accordance with character image signals.

Figure 3:
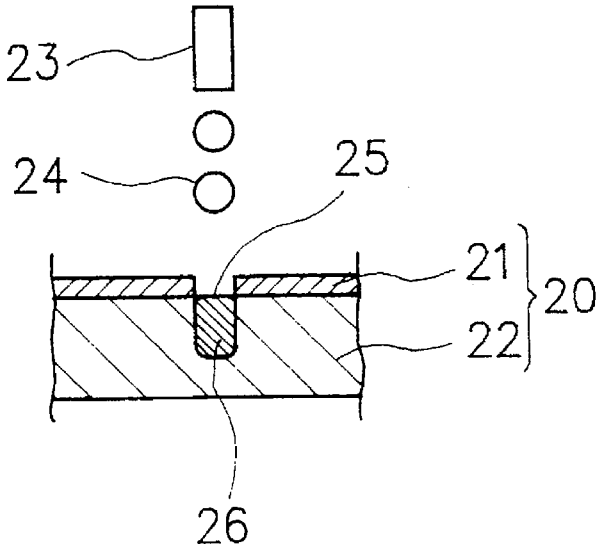
FIG. 3 is a view illustrating a state of perforating a stencil sheet used in one embodiment of the present invention by a solvent from the solvent applying means.

FIG. 3 shows a schematic view of preparation of the stencil sheet 10 in this embodiment. A solvent 24 discharged selectively in a contactless manner in accordance with image signals from the solvent supplying means is supplied on a solvent-soluble resin layer 21 of stencil sheet 20. The supplied solvent 24 dissolves and punctures the solvent-soluble resin layer 21 and a solution 26 is penetrated and diffused into the porous substrate 22 and a punctured portion 25 is formed to the solvent-soluble resin layer 21 at a portion in contact with the solvent 24 to perforate the stencil sheet 20.

Then, the solvent supplying means 23 is used for perforating the stencil sheet 20 as described above and can record characters or images by discharging the solvent directly to the printing paper. That is, the solvent 24 discharged selectively in a contactless manner in accordance with the image signals from the solvent supplying means 23 is supplied on the printing paper. Since the solvent contains a colorant, when the solvent is dried, images of a color depending on the colorant are formed on the printing paper.

Then, a recording apparatus 10 according to this embodiment is explained with reference to FIG. 1. The recording apparatus 10 has a perforating function of perforating the stencil sheet 20 by dissolving and puncturing the solvent-soluble resin layer 21 with the solvent, and a stencil printing function of conducting stencil printing by using the perforated stencil sheet 20. The stencil printing is effective in a case of obtaining a large number of identical printed matter. Further, the recording apparatus 10 also has a function of forming images by directly discharging the solvent to the printing paper 11. Image formation by the discharge of the solvent is effective in a case where the number of printing sheets of identical printed matter to be obtained is relatively small.

The recording apparatus 10 has a cylindrical drum 41 as a stencil printing means. The cylinder drum 41 is rotatable around a central axis of its own, and rotationally driven by a motor as a driving means not illustrated in a counterclockwise direction in the drawing. A portion of a circumferential wall of the drum 41 is an ink permeable region. An ink supplying means is disposed in the drum 41. The ink supplying means supplies ink 42 to the inner surface of the circumferential wall of the drum 41. The ink 42 supplied to the inner surface of the circumferential wall of the drum 41 is squeezed through the ink permeable region of the circumferential wall to the outside by a squeezing roller 43 disposed in the drum 41. The squeezed out ink 42 is externally squeezed by way of punctured images of the stencil sheet 20 wound around the drum 41 and deposited to the supplied printing paper 11 to form images. As the ink 42, an ink used generally for stencil printing, for example, oily ink, aqueous ink, water-in-oil droplet (W/O) type emulsion ink, oil-in-water (O/W) type emulsion ink can be utilized.

A clamp plate 40 as a stencil sheet holding means is disposed to the outside of the circumferential wall of the drum 41. A shaft 40*a* is disposed in parallel with one of generators of the drum 41 at a portion other than the ink permeable region of the circumferential wall of the drum 41. The clamp plate 40 is rotatable around the shaft 40*a* as the center. As shown in FIG. 1, when the clamp plate 40 reaches the topmost position of the drum 41, the clamp plate 40 holds the top end of the stencil sheet 20 supplied to the drum 41 by sandwiching it relative to the outer surface of the drum 41.

Figure 1:
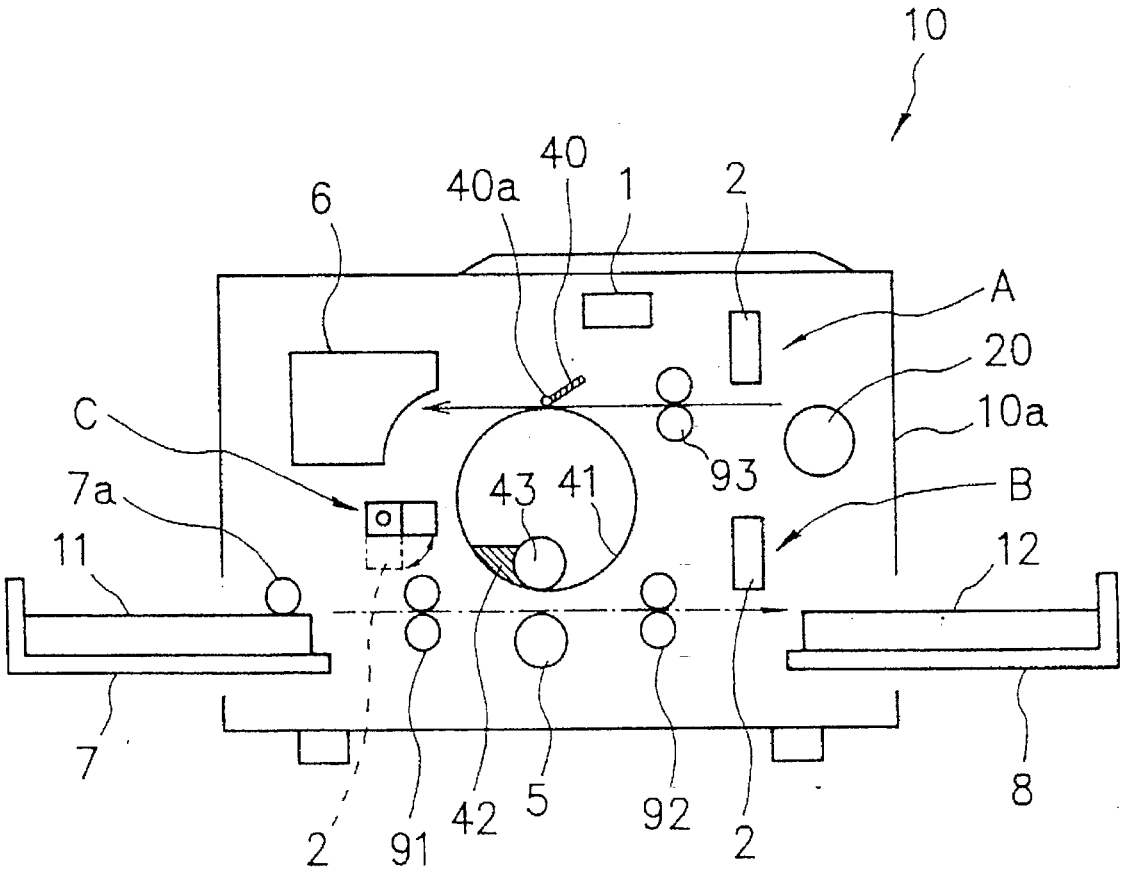
FIG. 1 is a view showing the entire constitution of one embodiment according to the present invention.

As shown in FIG. 1, the stencil sheet 20 rolled cylindrically is disposed to the upper right of the drum 41. The stencil sheet 20 is supplied by a conveyor roller 93 to the topmost portion of the drum 41.

The stencil sheet 20 is supplied to the drum 41 and the top end of the supplied stencil sheet 20 is held by the clamp plate 40. In this state, the drum 41 rotates in a counterclockwise direction in FIG. 1 and, when the conveyor roller 93 continuously delivers the stencil sheet 20 at an appropriate conveying speed, the stencil sheet 20 is wound around the outer circumferential surface of the drum 41 under a predetermined tension.

As shown FIG. 1, a sheet discharge portion 6 is disposed to the upper left of the drum 41 for discarding the stencil sheet 20. The sheet discharge portion 6 has a function of stripping off the used stencil sheet 20 from the drum 41, introducing it into a containing box and compressing it.

As shown in FIG. 1, a paper feed tray 7 is disposed to the lower left of the drum 41 for supplying the printing paper 11. A printing paper 11 stacked on the paper feed tray 7 is sent orderly from an upper one by a pick-up roller 7*a* to the drum 41. The sent printing paper 11 is conveyed by a conveyor roller 91 as the conveying means so as to pass a position below the drum 41.

As shown in FIG. 1, a press roller 5 is disposed below the drum 41 at a predetermined distance with the drum 41. The press roller 5 in this embodiment is vertically movable and moves vertically in synchronization with the rotation of the drum 41 and the conveyance of the printing paper 11 by the conveyor roller 91. That is, when the printing paper 11 is supplied between the drum 41 and the press roller 5 in synchronization with the rotation of the drum 41, the press roller 5 raises to sandwich the printing paper 11 relative to the drum 41 and conveys the printing paper 11 rightwardly in the drawing. The printing paper 11 is applied with stencil printing.

As shown in FIG. 1, a conveyor roller 92 as a conveying means for conveying the printed paper 12 rightwardly in the drawing and a paper discharge tray 8 for receiving the printing paper 12 conveyed to the conveyor roller 92 and successively stacking them are provided to the lower right of the drum 41.

As shown in FIG. 1, an image sensor 1 as a document reading means is disposed substantially above the drum 41. The image sensor 1 reads images of a document and outputs the image information as electric signals. The images referred to herein should be considered in a most broad meaning containing not only pictures, photographs, graphics and patterns but also characters and they include all objects that can be recognized visually irrespective of colors.

As shown in FIG. 1, a solvent supplying means 2 is disposed to the right of the drum 41 with the solvent being discharged downwardly. The solvent supplying means 2 has an identical constitution with the solvent supplying means 23. The solvent supplying means 2 is vertically movable to the right of the drum 41 and is selectively set at two positions A and B shown in FIG. 1.

The position A is a position for perforating the stencil sheet 20. The solvent supplying means at the position A conducts preparation by selectively discharging the solvent 24 in a contactless manner to the stencil sheet 20 conveyed by the conveyor roller 93 to the drum 41.

The position B is a position for recording images to the printing paper 11 by the solvent 24. The solvent supplying means 2 at the position B discharges the solvent 24 selectively in a contactless manner to the printing paper 11 conveyed by the conveyor roller 92 to form images on the printing paper 11.

Selection for the sitting position of the solvent supplying means 2 and discharge of the solvent 24 by the solvent supplying means 2 are conducted by a not illustrated driving control means. The driving control means controls driving of the drum 41, conveyance of the printing paper 11 or the like. In accordance with indication for stencil printing and/or solvent recording inputted from the outside, the position of the solvent supplying means 2 and the discharge of the solvent corresponding thereto are determined. Then, the solvent supplying means 2 is driven in synchronization with the driving for each of the portions of the recording apparatus in accordance with the image signals outputted from the image sensor 1.

The driving control means of this embodiment has a function of controlling the preparation of the stencil sheet 20, stencil printing using the perforated stencil sheet 20 and the operation of solvent recording or the like and may also have a function of controlling other operations appended to the above-mentioned operation, for example, an operation of winding the stencil sheet 20 around the drum 41 or plate discharging operation after printing.

Further, the driving control means of this embodiment can drive the solvent supplying means 2 by the image signals from the image sensor 1 and it can also drive the solvent supplying means 2 by image signals supplied from the outside of this recording apparatus 10. For example, the document may be read by an image processing device disposed to the outside of the recording apparatus 10 and the image information obtained therefrom may be supplied to the driving control means of this recording apparatus 10 to conduct preparation by the solvent supplying means 2.

Each of the constituent portions of the recording apparatus 10 described above is assembled to a not illustrated substrate and the entire portion is substantially covered with a casing 10*a*. The paper feed tray 7 and the paper discharge tray 8 can easily be attached to and detached from the casing 10*a* manually by an operator. Accordingly, the size of the printing paper 11 can optionally be selected as required.

Then, operation of the foregoing constitution will be explained. In FIG. 1, when a document is present, image signals read by the image sensor 1 are sent to the driving control means. Alternatively, image signals from other image signal supplying means such as personal computer (not illustrated) at the outside of the recording apparatus 10 are sent to the driving control means of the recording apparatus 10. The image signals held by the driving control means of the recording apparatus 10 are utilized for stencil printing and/or direct recording by the solvent supplying means 2, for example, in accordance with the instruction from the outside.

In a case of conducting printing for a small number of sheets to the printing paper 11, the solvent supplying means 2 is used as the recording means. In this instance, the solvent supplying means 2 is set near the conveying path of the printing paper 11. In this embodiment, the means is disposed at the position B as described above.

The printing paper 11 on the paper feed tray 7 is transported by the conveyor roller 91 and displaced by the conveyor roller 92 below the solvent supplying means 2 at the position B. The solvent supplying means 2 selectively discharges the colorant containing solvent 24 in synchronization with the transportation of the printing paper 11 to form images on the printing paper 11. The printing paper 11 formed with the images is conveyed by the conveyor roller 92 to the paper discharge tray 8 and stocked as the printing paper 12. Upon recording for a small number of sheets by the solvent supplying means 2, the press roller 5 is apart from the drum 41 and does not interfere with the conveyed printing paper 11.

In a case of conducting printing for a large number of sheets to the printing paper 11, the stencil sheet 20 is made-up and stencil printing is applied. In FIG. 1, the solvent supplying means 2 is disposed near the stencil sheet 10. In this embodiment, the means is disposed at the position A as described above.

As shown in FIG. 1, the stencil sheet 20 is delivered by the conveyor roller 93. The solvent supplying means 2 disposed at the position A discharges the solvent to the stencil sheet 20 conveyed by the conveyor roller 93, that is, to the stencil sheet 20 before attached to the drum 41.

The perforated stencil sheet 20 is conveyed by the conveyor roller 93 toward the drum 41, and the top end is held by the clamp plate 40. Along with the rotation of the drum 41, the stencil sheet 20 is wound around the outer circumferential surface of the drum 41 while undergoing tension. The stencil sheet 20 is cut by a not illustrated cutter. The stencil sheet 20 is wound around the drum 41 with no creasing.

In synchronization with the rotation of the drum 41, the printing paper 11 on the paper feed tray 7 is transported by the conveyor roller 91 and is tightly pressed onto the stencil sheet 20 while being put between the press roller 5 and the drum 41. The ink 42 passing from the punctured portion of the made-up stencil sheet 20 is transferred to the printing paper 11 to conduct stencil printing. The printing paper 12 after printing is conveyed by the conveyor roller 92 as far as the paper discharge tray 8 and then stocked. The dotted arrow in FIG. 1 indicates the conveying path of the printing paper 11, 12. Since no molten products remain in the punctured portion of the perforated stencil sheet 20, passage of ink is not hindered and clear printed matter can be obtained.

The recording apparatus 10 of this embodiment can provide printed matter applied with both of recordings of the direct recording by the colorant-containing solvent and recording by stencil printing on one identical printing paper. At first the stencil sheet 10 is made-up by the solvent supplying means 2 set at the position A and wound around the drum 41 to conduct stencil printing. When direct recording is conducted by the solvent supplying means 2, the solvent supplying means 2 is set at the position B.

The stencil printing operation and the solvent direct recording can be conducted continuously on every sheet of printing paper. Further, the stencil printing operation and the solvent direct printing can be conducted separately in different steps. For example, stencil printing is at first applied to a required number of sheets of printing paper, the printing paper after stencil printing is returned again to the paper feed tray 7 and the direct printing with the solvent may be conducted to the printing paper in the subsequent step.

Alternatively, the direct recording by the solvent is applied previously and the printing paper after direct recording is put to stencil printing.

In the embodiment explained above, one solvent supplying means 2 is disposed and direct recording to the printing paper 11 and preparation to the stencil sheet 20 can be conducted selectively by varying the position. However, direct recording and solvent supplying means may be disposed respectively and fixedly arranged, for example, on the positions A and B.

Further, as shown in FIG. 1, one solvent supplying means 2 may be disposed at a position C left to the drum 41. The solvent supplying means 2 is movable between a first position for directing the top end of discharging solvent to the circumferential surface of the drum 41 and a second position of directing the top end to the transported printing paper 11. A concrete structure for making the solvent supplying means 2 movable in such a way can be provided by disposing a rotational shaft at the end opposite to the end of discharging solvent and making the solvent supplying means 2 rotatable by about 90 degrees around the rotational shaft as the center.

In the case of disposing one solvent supplying means 2 at the position C, the stencil sheet 20 is made-up after attaching the stencil sheet 20 to the drum 41. Since the stencil sheet 20 is wound around the drum 41 and then the solvent is discharged in a contactless manner from the solvent supplying means 20 to conduct make-up no creasing occurs to the stencil sheet 20. Further, when the stencil sheet 20 is attached to the drum 41, even if the stencil sheet 20 runs obliquely and is attached obliquely, or even if creasing should occur, since make-up is applied in a contactless manner to the stencil sheet 20, the stencil sheet 20 is not wasted.

In a recording apparatus in which one solvent supplying means 2 is disposed at the position C, when direct recording by the solvent and stencil printing are conducted continuously on every sheet of printing paper, the printing paper 11 is at first put to direct recording by the solvent and immediately thereafter, put to stencil printing and then discharged to the paper discharge tray 8. Also in the recording apparatus in which one solvent supplying means 2 is disposed at the position C, direct recording by the solvent and the stencil printing can be conducted separately in different steps.

In the embodiments described above, the tone of the solvent discharged from the solvent supplying means 2 may be different from the tone of the ink in the drum 41 used upon printing a number of sheets. For instance, if the tone of the solvent is, for example, red and blue which is used less frequently, while the ink in the drum 41 is a black or like other ink which is used frequently, black printing for a number of sheets by stencil printing using the drum 41 and direct recording, for example, red and blue which is used less frequently can be conducted simply on one sheet of recording paper and multi-colored printed matter can be obtained efficiently.

In the embodiments described above, although the solvent supplying mean for direct recording by the solvent is provided by one, a plurality of solvent supplying means for discharging solvents of different tones may be disposed so that direct recording can be applied to the printing paper by a plurality of colors. Particularly, it may be adapted such that three kinds of solvents having each of three primary color tones can be selectively discharged to the printing paper and full color images are formed on the printing paper.

As has been described above, the recording apparatus according to the present invention has a solvent supplying means for discharging a colorant-containing solvent, the stencil sheet having the solvent-soluble resin layer can be perforated by the solvent supplying means and the solvent can be discharged directly from the solvent supplying means to the printing paper to conduct recording. Accordingly, both of direct printing and stencil printing can be applied to one kind of printing paper, and recording for a small number of sheets and printing for a large number of sheets can be conducted at a reduced running cost efficiently by one small-sized recording apparatus. Further, color recording can also be conducted at a low cost.

What is claimed is:

1. A recording apparatus for a stencil sheet with a solvent-soluble resin layer, comprising:

a drum rotationally driven around a central axis thereof and adapted to receive the stencil sheet around an outer circumferential surface of the drum, ink supplying means disposed to an inside of the drum and supplying ink to an inner circumferential surface of the drum, means for supplying printing sheets one by one from a sheet feed section to the drum, and one solvent supplying means containing a solvent with a colorant, said solvent supplying means for supplying the solvent selectively to the stencil sheet for perforating the stencil sheet and one of the printing sheets transferred by the supplying means for recording on the one of the printing sheets.

2. A recording apparatus as defined in claim 1, wherein the solvent supplying means perforates the stencil sheet it is before attached to the outer circumferential surface of the drum.

3. A recording apparatus as defined in claim 1, wherein the solvent supplying means perforates the stencil sheet after it is attached to the outer circumferential surface of the drum.

4. A recording apparatus as defined in claim 1, wherein said colorant in the solvent is different from a colorant in the ink.

5. A recording apparatus as defined in claim 1, wherein said solvent supplying means is situated near the drum and supplies the solvent to the stencil sheet when the stencil sheet is perforated, and to one of the printing sheets during transfer from the sheet feed section to a sheet discharge section when a record is made on the one of the printing sheets with the solvent.

6. A recording apparatus as defined in claim 5, wherein said sheet feed section includes a paper feed tray, and said sheet discharge section includes a paper discharge tray.

7. A recording apparatus for a stencil sheet with a solvent-soluble resin layer, comprising:

a drum rotationally driven around a central axis thereof and adapted to receive the stencil sheet around an outer circumferential surface of the drum, ink supplying means disposed to an inside of the drum and supplying ink to an inner circumferential surface of the drum, and solvent supplying means for selectively supplying a solvent containing a colorant to the stencil sheet, means for moving said solvent supplying means between a position for supplying the solvent to the stencil sheet and a position for supplying the solvent to a printing sheet, to thereby perforate the stencil sheet and selectively supply the solvent to the printing sheet for conducting recording.

* * * * *